US007395898B2

(12) United States Patent
Yang et al.

(10) Patent No.: US 7,395,898 B2
(45) Date of Patent: Jul. 8, 2008

(54) SOUND ATTENUATING STRUCTURES

(75) Inventors: Zhi Yu Yang, Hong Kong (CN); Weijia Wen, Hong Kong (CN); Ping Sheng, Hong Kong (CN); Xixiang Zhang, Hong Kong (CN)

(73) Assignee: RSM Technologies Limited, Hong Kong (CN)

( * ) Notice: Subject to any disclaimer, the term of this patent is extended or adjusted under 35 U.S.C. 154(b) by 457 days.

(21) Appl. No.: 10/792,783

(22) Filed: Mar. 5, 2004

(65) Prior Publication Data

US 2005/0194209 A1 Sep. 8, 2005

(51) Int. Cl.
*E04B 1/82* (2006.01)

(52) U.S. Cl. ..... 181/286

(58) Field of Classification Search ..... 181/286, 181/284, 288, 295, 207, 208, 209, 211, 151
See application file for complete search history.

(56) References Cited

U.S. PATENT DOCUMENTS 2,541,159 A * 2/1951 Geiger ..... 181/208
4,373,608 A * 2/1983 Holmes ..... 181/202
4,421,811 A * 12/1983 Rose et al. ..... 428/116
4,475,624 A * 10/1984 Bourland et al. ..... 181/292
5,180,619 A * 1/1993 Landi et al. ..... 428/116
6,576,333 B2 6/2003 Sheng et al.
2002/0046901 A1 * 4/2002 Zapfe ..... 181/206
2003/0062217 A1 4/2003 Sheng et al.
2005/0189165 A1 * 9/2005 Mathur ..... 181/207

FOREIGN PATENT DOCUMENTS

JP 401189697 * 7/1989
JP 402272795 * 11/1990

* cited by examiner

*Primary Examiner*—Lincoln Donovan
*Assistant Examiner*—Forrest Phillips
(74) *Attorney, Agent, or Firm*—Buchanan Ingersoll & Rooney PC

(57) ABSTRACT

There is disclosed a sound attenuation panel comprising, a rigid frame divided into a plurality of individual cells, a sheet of a flexible material, and a plurality of weights. Each weight is fixed to the sheet of flexible material such that each cell is provided with a respective weight and the frequency of the sound attenuated can be controlled by suitable selecting the mass of the weight.

16 Claims, 5 Drawing Sheets

Top view of a schematic drawing of a LRSM panel

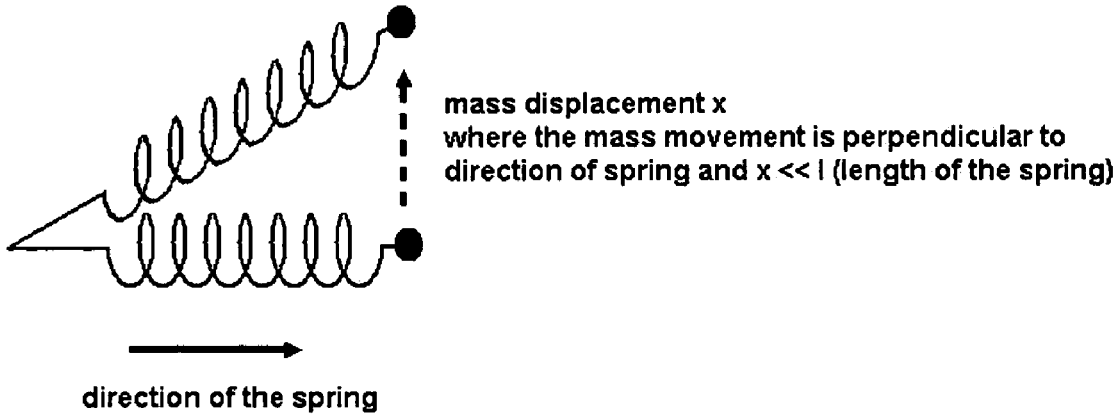
Fig. 1 An illustration of mass displacement transverse to a spring
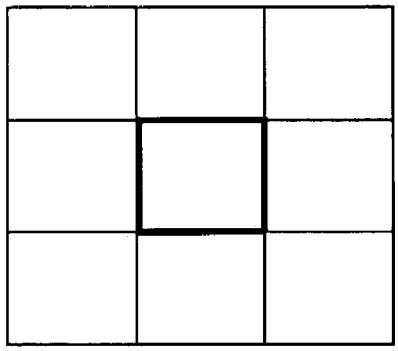
Fig. 2 An example of a rigid frame of LRSM panel.
A single cell is delineated by bold lines.
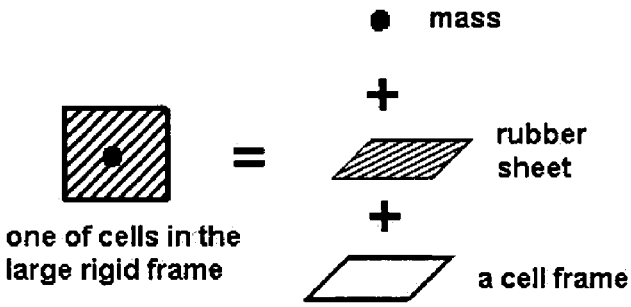
Fig. 3 Top view of a schematic drawing of a cell in the rigid frame

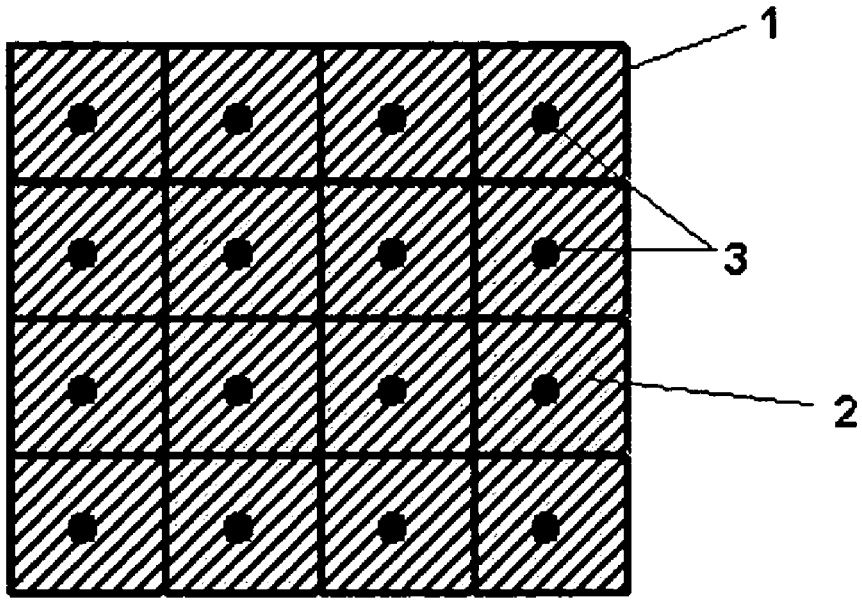
Fig. 4 Top view of a schematic drawing of a LRSM panel

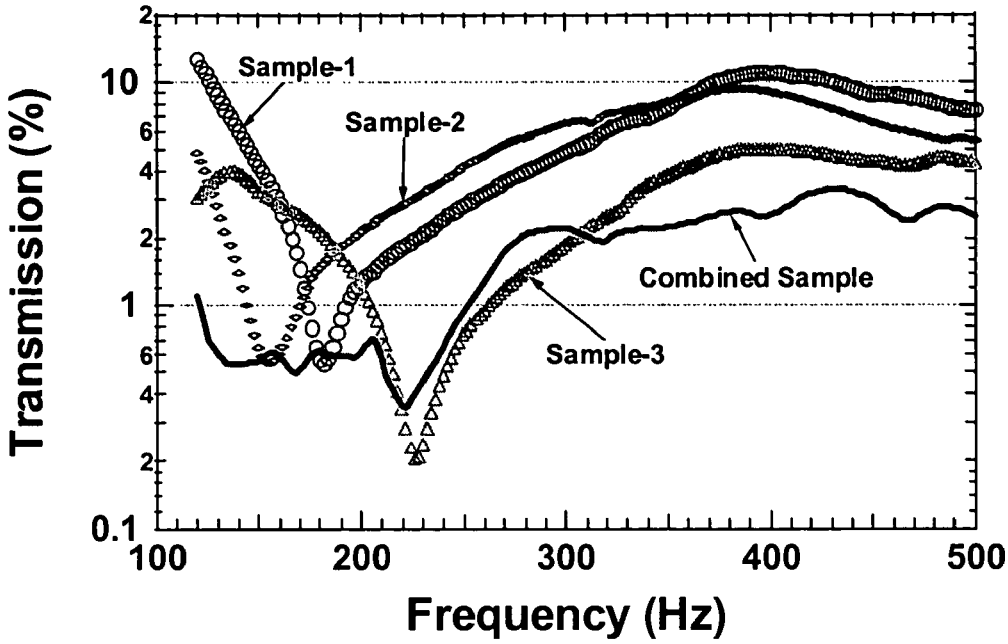
Fig. 5 shows the transmission spectra of 3 individual LRSM panels and that for a panel consisting of the three LRSM panels stacked together.
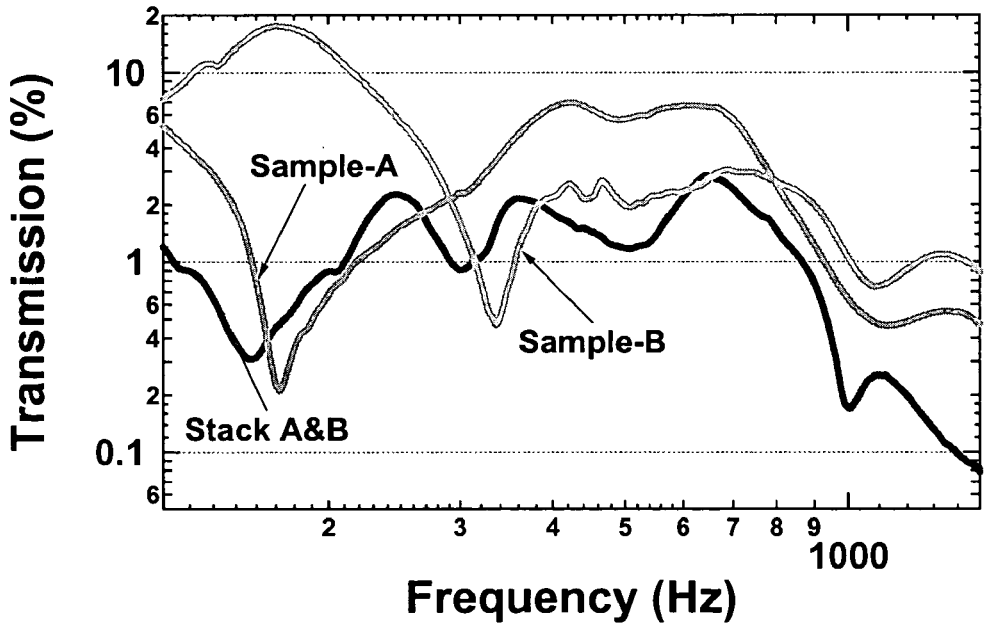
Fig. 6 shows the transmission spectra of 2 individual LRSM panels and a panel consisting of the two LRSM panels stacked together.

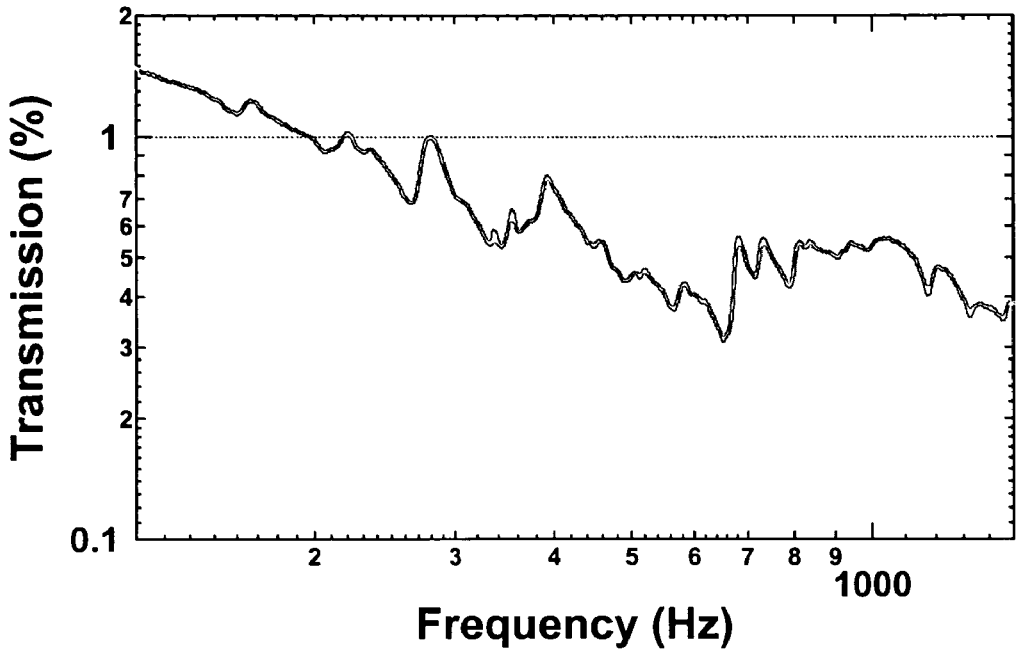
Fig. 7 shows the transmission spectrum of a solid panel
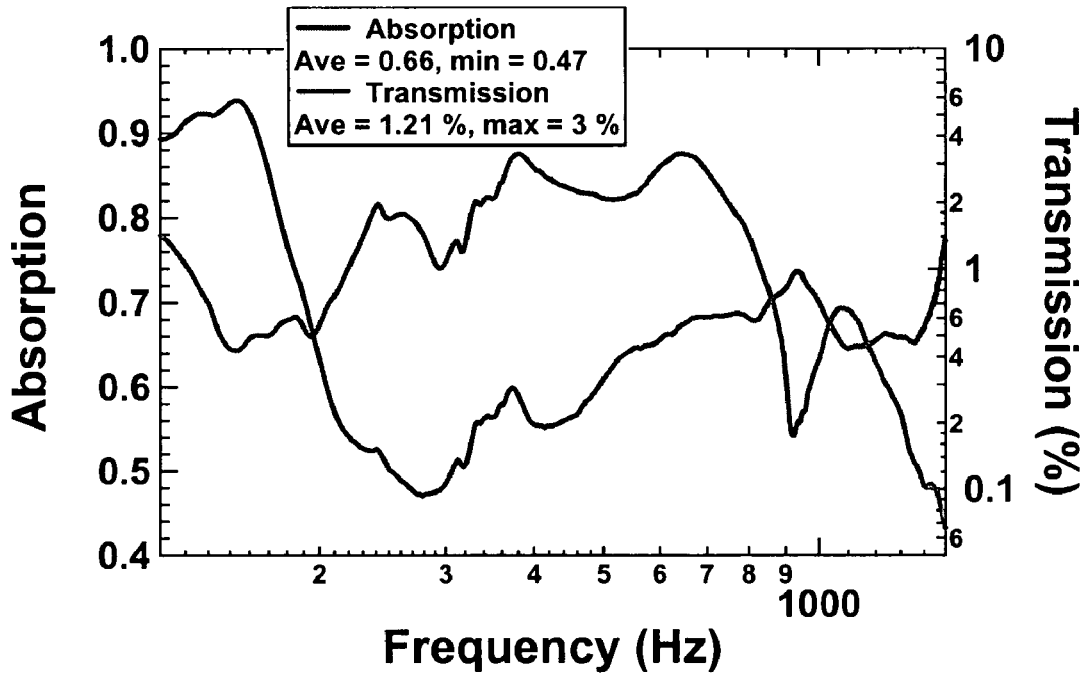
Fig. 8 shows the results of a high absorption and low transmission panel. The scale for the red curve is to the left. The scale for the green curve is to the right.

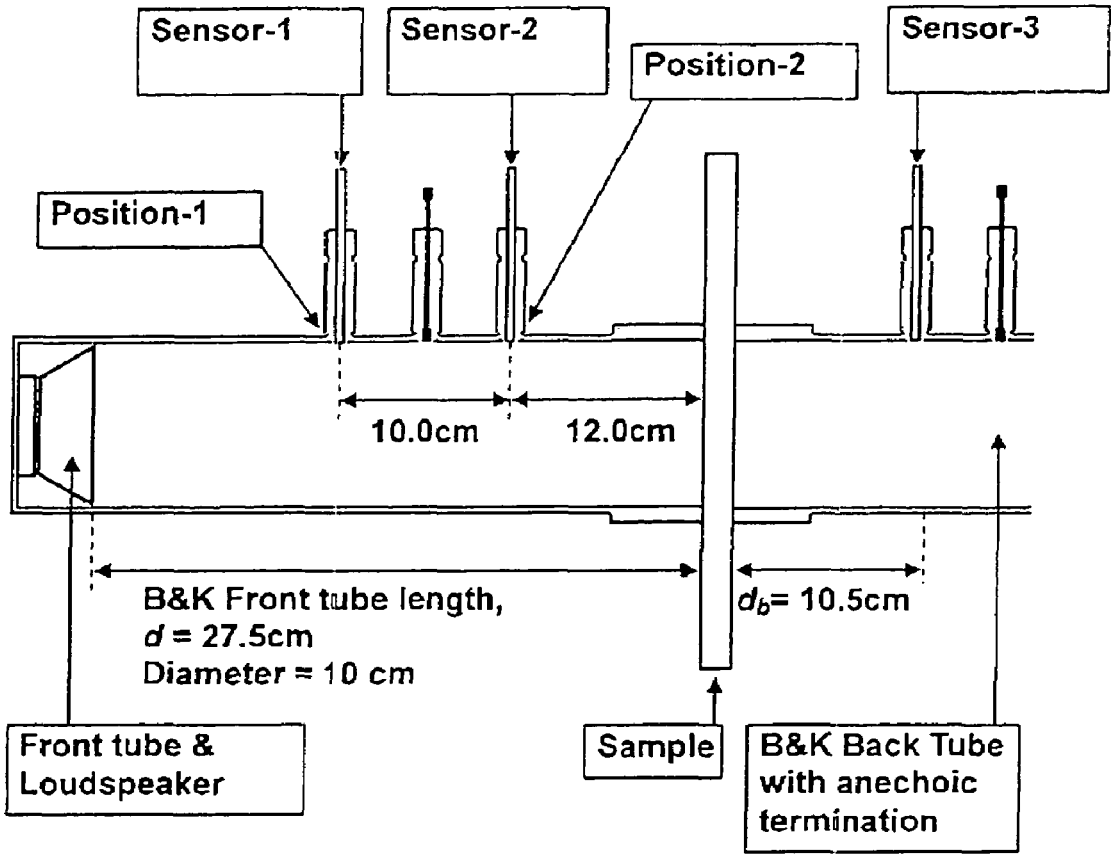
Fig. 9 Schematics of the measurement apparatus
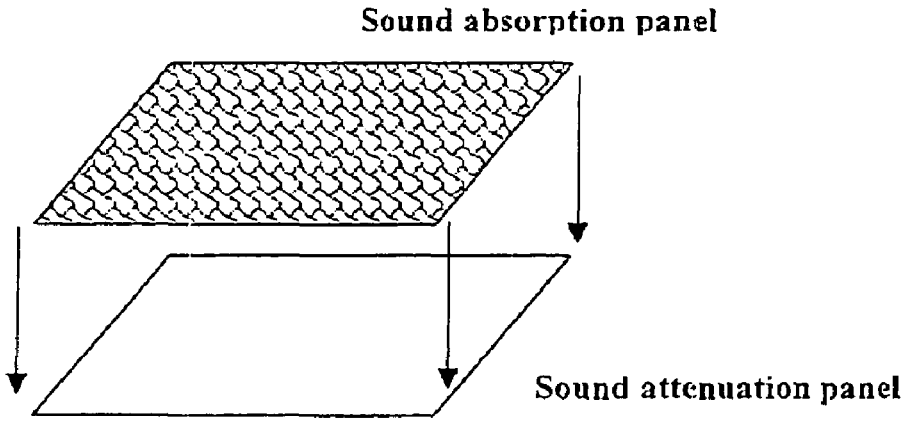
Fig. 10 Schematics of the assembly of the sound panels

SOUND ATTENUATING STRUCTURES

FIELD OF THE INVENTION

This invention relates to novel sound attenuating structures, and in particular to locally resonant sonic materials (LRSM) that are able to provide a shield or sound barrier against a particular frequency range and which can be stacked together to act as a broad-frequency sound attenuation shield.

BACKGROUND OF THE INVENTION AND PRIOR ART

In recent years, a new class of sonic materials has been discovered, based on the principle of structured local oscillators. Such materials can break the mass density law of sound attenuation, which states that in order to attenuate sound transmission to the same degree, the thickness, or mass per unit area, of the solid panel has to vary inversely with the sound frequency. Thus with the conventional sound attenuation materials low frequency sound attenuation can require very thick solid panels, or panels made with very high density material, such as lead.

The basic principles underlying this new class of materials, denoted as locally resonant sonic materials (LRSM) have been published in Science, vol. 289, p. 1641-1828 (2000), and such materials are also described in U.S. Pat. No. 6,576,333, and U.S. patent application Ser. No. 09/964,529 on the various designs for the implementation of this type of LRSM. However, current designs still suffer from the fact that the breaking of the mass density law is only confined to a narrow frequency range. Thus in applications requiring sound attenuation over a broad frequency range the LRSM can still be fairly thick and heavy.

SUMMARY OF THE INVENTION

According to the present invention there is provided a sound attenuation panel comprising, a rigid frame divided into a plurality of individual cells, a sheet of a flexible material, and a plurality of weights wherein each said weight is fixed to said sheet of flexible material such that each cell is provided with a respective weight.

Preferably each weight is provided in the center of a cell.

The flexible material may be any suitable soft material such as an elastomeric material like rubber, or a material such as nylon. Preferably the flexible material should have a thickness of less than about 1 mm. Importantly the flexible material should ideally be impermeable to air and without any perforations or holes otherwise the effect is significantly reduced.

The rigid frame may be made of a material such as aluminum or plastic. The function of the grid is for support and therefore the material chosen for the grid is not critical provided it is sufficiently rigid and preferably lightweight.

Typically the spacing of the cells within the grid is in the region of 0.5-1.5 cm. In some cases, in particular if the flexible sheet is thin, the size of the grid can have an effect on the frequency being blocked, and in particular the smaller the grid size, the higher the frequency being blocked. However the effect of the grid size becomes less significant if the flexible sheet is thicker.

A typical dimension for one of the weights is around 5 mm with a mass in the range of 0.2 to 2 g. Generally all the weights in one panel will have the same mass and the mass of the weight is chosen to achieve sound attenuation at a desired frequency, and if all other parameters remain the same the frequency blocked will vary with the inverse square root of the mass. The dimensions of the weights are not critical in terms of the frequency being blocked, but they may affect the coupling between the incoming sound and the resonant structure. A relatively "flat" shape for the weight may be preferred, and hence a headed screw and nut combination is quite effective. Another possibility is that the weight may be formed by two magnetic components (such as magnetic discs) that may be fixed to the membrane without requiring any perforation of the membrane, instead one component could be fixed on each side of the membrane with the components being held in place by their mutual attraction.

A single panel may attenuate only a relatively narrow band of frequencies. However, a number of panels may be stacked together to form a composite structure. In particular if each panel is formed with different weights and thus attenuating a different range of frequencies, the composite structure may therefore have a relatively large attenuation bandwidth.

Accordingly therefore the invention also extends to sound attenuation structure comprising a plurality of panels stacked together wherein each said panel comprises a rigid frame divided into a plurality of individual cells, a sheet of a soft material, and a plurality of weights wherein each said weight is fixed to said sheet of soft material such that each cell is provided with a respective weight.

An individual sound attenuating panel as described above is generally sound reflecting. If it is desired to reduce the sound reflection then a panel as described above may be combined with a known sound absorbing panel.

Accordingly therefore the invention also extends to a sound attenuation structure comprising, a rigid frame divided into a plurality of individual cells, a sheet of a soft material, and a plurality of weights wherein each said weight is fixed to said sheet of soft material such that each cell is provided with a respective weight, and a sound absorption panel.

BRIEF DESCRIPTION OF THE DRAWINGS

Some embodiments of the invention will now be described by way of example and with reference to the accompanying drawings, in which:

FIG. 1 is an illustration of mass displacement transverse to a spring,

FIG. 2 illustrates a rigid frame comprising a number of LRSM cells with a single cell being delineated by bold lines, FIG. 3 shows a single cell with a top view and in an exploded view, FIG. 4 shows a top view of an LRSM panel according to an embodiment of the invention, FIG. 5 shows the transmission spectra of three individual LRSM panels according to embodiments of the invention and that for a panel consisting of the three LRSM panels stacked together, FIG. 6 shows the transmission spectra of two individual LRSM panels according to embodiments of the invention and a panel consisting of the two LRSM panels stacked together, FIG. 7 shows the transmission spectrum of a solid panel for comparison, FIG. 8 shows the results of a high absorption and low transmission panel FIG. 9 illustrates schematically the measurement apparatus used to obtain the results of FIGS. 5 to 8.

FIG. 10 illustrates an LSRM panel in combination with a second absorption panel.

DETAILED DESCRIPTION OF PREFERRED EMBODIMENTS

The current invention relates to a new type of LRSM design. Basically, the local oscillators can be regarded as composed of two components: the mass m of the oscillator, and the spring K of the oscillator. It is usually counter productive to increase m since that will increase the overall weight of the panels. Hence one should choose to lower K. However, a lower K is usually associated with soft materials, which would be difficult to sustain structurally. In preferred embodiments of the present invention, however, a lower K is achieved through geometric means as will be seen from the following.

Consider the usual mass-spring geometry whereby the mass displacement x is equal to the spring displacement, so that the restoring force is given by Kx. Consider the case in which the mass displacement is transverse to the spring as shown in FIG. 1. In that case the mass displacement x will cause a spring elongation in the amount of $(1/2)*l*(x/l)^2=x^2/2l$, where l is the length of the spring. Thus the restoring force is given by $Kx*(x/2l)$. Since x is generally very small, the effective spring constant $K'=K*(x/2l)$ is thus significantly reduced. As the local oscillator's resonance frequency is given by $$f = \frac{1}{2\pi}\sqrt{\frac{K'}{m}}$$

it follows that a weak effective K' would yield a very low resonance frequency. Thus we can afford to use a lighter mass m in our design and still achieve the same effect.

The above discussion is for extreme cases where the diameter of the spring, or rather that of an elastic rod, is much smaller than its length l. When the diameter is comparable to l, the restoring force is proportional to the lateral displacement x and the force constant K' would hence be independent of x. For medium-range diameters K' changes gradually from independent of x to linearly dependent on x, i.e., the x-independent region of the displacement gradually shrinks to zero. In two-dimensional configurations, this corresponds to a mass on an elastic membrane with thickness ranging from much smaller than the lateral dimension to comparable to it. The effective force constant K' depends on the actual dimensions of the membrane as well as the tension on the elastic membrane. All these parameters can be adjusted to obtain the desired K' to match the given mass, so as to achieve the required resonance frequency. For example, to reach higher resonance frequency one could use either lighter weights, or increase the K' of the membrane by stacking two or more membranes together, the effect of which is the same as using a single but thicker membrane. The resonance frequency may also be adjusted by varying the tension in the membrane when it is secured to the rigid grid. For example if the tension of the membrane is increased then the resonance frequency will also increase.

FIG. 2 shows an example of a rigid grid for use in an embodiment of the present invention and divided into nine identical cells, with the central cell highlighted for clarity. The grid may be formed of any suitable material provided it is rigid and preferably lightweight. Suitable materials for example include aluminum or plastic. Typically the cells are square with a size of around 0.5 to 1.5 cm.

As shown in FIG. 4, a LRSM panel according to an embodiment of the invention comprises a plurality of individual cells, with each cell being formed of three main parts, namely the grid frame 1, a flexible sheet such as an elastomeric (eg rubber) sheet 2, and a weight 3. The hard grid provides a rigid frame onto which the weights (which act as the local resonators) can be fixed. The grid itself is almost totally transparent to sound waves. The rubber sheet, which is fixed to the grid (by glue or by any other mechanical means) serves as the spring in a spring-mass local oscillator system. A screw and nut combination may be fastened onto the rubber sheet at the center of each grid cell to serves as the weight.

The flexible sheet may be a single sheet that covers multiple cells, or each cell may be formed with an individual flexible sheet attached to the frame. Multiple flexible sheets may also be provided superimposed on each other, for example two thinner sheets could be used to replace one thicker sheet. The tension in the flexible sheet can also be varied to affect the resonant frequency of the system.

The resonance frequency (natural frequency) of the system is determined by the mass m and the effective force constant K of the rubber sheet, which is equal to the rubber elasticity times a geometric factor dictated by the size of the cell and the thickness of the rubber sheet, in a simple relation $$f = \frac{1}{2\pi}\sqrt{\frac{K'}{m}}.$$

If K is kept constant, the resonance frequency (and therefore the frequency at which transmission is minimum) is proportional to $\sqrt{1/m}$. This can be used to estimate the mass needed to obtain the desired dip frequency.

Four samples of LRSM panels made in accordance with the design of FIG. 4 were constructed for experimental purposes with the following parameters.

Sample 1

The panel of Sample 1 consists of two grids with one grid superimposed on the other and the grids being fixed together by cable ties. Each cell is square with sides of 1.5 cm and the height of each grid is 0.75 cm. Two rubber sheets (each 0.8 mm thick) are provided with one sheet being held between the two grids, and the other sheet being fixed over a surface of the panel. Both sheets are fixed to the grids without any prior tension being applied. A weight is attached to each rubber sheet in the center of the sheet in the form of a stainless steel screw and nut combination. In Sample 1 the weights of each screw/nut combination is 0.48 g.

Sample 2

The panel of Sample 2 is identical to Sample 1 except that the weight of each screw/nut combination is 0.76 g.

Sample 3

The panel of Sample 3 is identical to Sample 1 except that the weight of each screw/nut combination is 0.27 g.

Sample 4

The panel of Sample 4 is identical to Sample 1 except that the weight of each screw/nut combination is 0.136 g and the screw/nut combination is formed of Teflon.

FIG. 5 shows the amplitude transmission (t in Eq. (4) in the appendix below) spectra of Samples 1 to 3 and also a panel that is formed of Samples 1, 2 and 3 stacked together to form a combined panel. A single transmission dip is seen for each Example when they were measured individually. Sample 1 shows a transmission dip at 180 Hz, Sample 2 a dip at 155 Hz, and Sample 3 a dip at 230 Hz. The transmission dip shifts to lower frequencies with increasing mass of the screw/nut, following the predicted $\sqrt{1/m}$ relation. The curve of the measured transmission of the combined panel formed when the three Samples were stacked together shows that together they form a broadband low transmission sound barrier. Between 120 and 250 Hz the transmission is below 1%, which implies transmission attenuation of over 40 dB. Over the entire 120 to 500 Hz the transmission is below 3%, which implies over 35 dB transmission attenuation.

For sound insulation at higher frequencies lighter weight is used as in Sample 4. FIG. 6 shows the transmission spectra of Samples 1 and 4, measured separately, and the spectrum when the two were stacked together. Again, the stacked sample exhibits the broad frequency transmission attenuation (from ~120 Hz to 400 Hz) not achieved in each of the single panels on their own.

To compare these results with the traditional sonic transmission attenuation techniques, it is possible to use the so-called mass-density law of sound transmission (in air) through a solid panel with mass density ρ and thickness d: $t \propto (f d \rho)^{-1}$. At ~500 Hz, it is comparable to a solid panel with more than one order of magnitude heavier in weight, not to mention even lower frequencies.

FIG. 7 shows the transmission spectrum of a solid panel sample which is 4 cm thick with an area mass density of 33 $lb/ft^2$. The panel is made from bricks of "rubber soil". The general trend of the transmission is that it increases with lower frequency, just as predicted by the mass law. The fluctuation is due to the internal vibration of the panel, which is not completely rigid.

The LRSM panels of preferred embodiments of the invention all have reflection near 90%, and a low reflection panel may be added to reduce the reflection or increase the absorption. FIG. 8 shows the absorption (lefthand axis) ($=1-r*r-t*t$), where r is the reflection coefficient and t the transmission coefficient (righthand axis), of the stacked panel (consisting of the samples 1 & 4 in FIG. 6 and the low reflection panel) to be 66% averaged over the 120 Hz to 1500 Hz range. In this case the low reflection panel is a combination of a holed plate which is a metal with tapered holes ranging in diameter from 1 mm to 0.2 mm, at a density of 10 holes per $cm^2$, followed by a layer of fiberglass. The transmission amplitude is below 3% at all frequencies, and the average value is 1.21%, or 38 dB over the 120 to 1500 Hz range. The total aerial weight of the combined panel is about 4.5 $lb/ft^2$, or 22 $kg/M^2$. This is lighter than a typical ceramic tile. The total thickness is less than 3 cm.

As can be seen from the above description of preferred embodiments, the LRSM panels of preferred embodiments of the present invention are formed of a rigid frame with cells, over which is fixed a soft material such as a thin rubber sheet. In each of the cells a small mass can then be fixed to the center of the rubber sheet (FIG. 3).

The frame can have a small thickness. In this manner, when a sound wave in the resonance frequency range impinges on the panel, a small displacement of the mass will be induced in the direction transverse to the rubber sheet. The rubber sheet in this case acts as the weak spring for the restoring force. As a single panel can be very thin, a multitude of sonic panels can be stacked together to act as a broad-frequency sound attenuation panel, collectively breaking the mass density law over a broad frequency range.

Compared with previous designs, this new design has the following advantages: (1) the sonic panels can be very thin, (2) the sonic panels can be very light (low in density), (3) the panels can be stacked together to form a broad-frequency LRSM material which can break the mass density law over a broad frequency range. In particular, it can break the mass density law for frequencies below 500 Hz; (4) the panels can be fabricated easily and at low cost.

The LRSM is inherently a reflecting material. By itself it has very low absorption. Hence in applications where low reflection is also desired, the LRSM may be combined with other sound absorbing materials, in particular a combined LRSM-absorption panel can act as a low-transmission, low-reflection sound panel over the frequency range of 120-1000 Hz. Usually over 1000 Hz the sound can be easily attenuated, and no special arrangement would be needed. Thus in essence the present sonic panels can solve the sound attenuation problems in both indoor and outdoor applications, over a very wide frequency range.

For indoor applications, for example in wood-frame houses where the walls are fabricated using wood frames with gypsum boards, LRSM panels according to embodiments of the present invention can be inserted between the gypsum boards, to achieve superior sound insulation between rooms by adding more than 35 dB of transmission loss to the existing walls. For outdoor applications, the panels can also be used as inserts inside the concrete or other weather-proofing frames, and to shield environmental noise (especially the low frequency noise).

Appendix

Measurement Technique

The measurement approach is based on modifying the standard method [ASTM C384-98 "Standard test method for impedance and absorption of acoustical materials by the impedance tube method."]. Impedance tubes were used to generate plane sound waves inside the tube while screening out room noise. FIG. 9 shows the schematics of the approach. The sample slab 9 being measured was placed firmly and tightly between two Brüel & Kjær (B&K) Type-4026 impedance tubes 10,11 as required by the standard method. The front tube 10 contained a B&K loudspeaker 12 at the far end, and two Type-4187 acoustic sensors 13,14 as in the standard method. A third acoustic sensor 15 with an electronic gain ~100 times that of the front sensors 13,14 was placed at the fixture of the back tube 11. The rest of the back tube after the sensor was filled with anechoic sound absorbing sponge 16. This is the additional feature that the original standard method does not have, and is designed to measure with precision the transmission of the sample.

The front tube 10 has a length $d_f$=27.5 cm and a diameter of 10 cm. First and second sensors 13,14 are spaced apart by 10 cm, and the second sensor is spaced from the sample 9 by 10.5 cm. Third sensor 15 in the back impedance tube 11 is spaced from sample 9 by 10.5 cm and the back tube 11 has the same diameter as the front tube 10, ie 10 cm.

The back impedance tube 11 effectively shields the room noise from the third sensor 15, so that the measurements can be carried out in a normal laboratory (instead of a specially equipped quiet room). A sinusoidal signal was sent from a lock-in amplifier to drive the loudspeaker 12 through a power amplifier, which also measured the signal from third sensor 15. The frequency of the wave was scanned in a range from 200 Hz to 1400 Hz at 2 Hz intervals, while the electric signals, both in-phase and out-phase, were measured by the three (two-phase) lock-in amplifiers. Single frequency excitation and phase sensitive detection significantly improved the signal to noise ratio as compared to the more widely employed broadband source with autocorrelation multi-channel frequency analysis, which is more susceptible to noise interference at low frequencies. All sensors have been calibrated to obtained their relative response curves by the conventional switching position method.

For completeness, below is given the derivation of the relevant formulae used in the data analysis. The following terms used in the derivation will first be defined:

$\theta_n = 2\pi f d_n / c$; c=speed of sound in air; f=frequency; $k = 2\pi f / c$ $d_{1,2,3}$=the distance from sample to the positions of first sensor 13, second sensor 14, and third sensor 15, respectively; $d_f$=length of the front impedance tube and $d_b$=length of the back impedance tube.

$r_s$=reflection coefficient of the loudspeaker; r=reflection coefficient of the sample.

t=transmission coefficient of the sample.

$X_n$=signal at sensor-n; A=amplitude of the wave emitted by the loudspeaker.

By assuming the sound wave being a plane wave in the tube, and by taking the Z-axis direction to the right and z=0 at the sample surface, the amplitudes at first sensor 13 and second sensor 14 are given by $$X_{1,2} = A\frac{e^{-i\theta_{1,2}} + re^{i\theta_{1,2}}}{1 - r_s r e^{2i\theta_f}}. \quad \text{Eq (1)}$$

The sound wave at the back surface of the sample is then $$\left(\frac{A}{1 - r_s r e^{2i\theta_f}}\right)t.$$

By taking z=0 at the back side of the sample for the waves in the back tube, the signal at the third sensor 15 is $$X_3 = \frac{Ae^{i\theta_3}}{1 - r_s r e^{2i\theta_f}}t. \quad \text{Eq (2)}$$

From Eq. (1) the reflection coefficient r of the sample is obtained as $$r = \frac{e^{-i\theta_2} - H_{1,2}e^{-i\theta_1}}{H_{1,2}e^{-i\theta_1} - e^{i\theta_2}}, \quad \text{Eq (3)}$$

where $H_{1,2}$ $X_2/X_1$. Equation (3) is the same as used in the standard two-microphone method to determine the reflection r using the measured transfer function $H_{1,2}$.

The transmission coefficient t can be obtained through $X_3/X_2$ and r in Eqts (1) and (2):

$$t = e^{-i}\vartheta^3(e^{-\theta_2} + re^{i\theta_2})X_3/X_2. \quad \text{Eq(4)}$$

The transmission loss (TL) is defined as TL (dB)=−20*log (|t|).

The invention claimed is:

1. A sound attenuation panel comprising, a substantially acoustically transparent planar, rigid frame divided into a plurality of individual cells, wherein said plurality of individual cells are generally two-dimensional cells, a sheet of a flexible material fixed to the rigid frame, and a plurality of weights wherein each said weight is fixed to said sheet of flexible material such that each cell is provided with a respective weight;

whereby resonant frequency of said sound attenuation panel is defined by the planar geometry of each said individual cell, the flexibility of said flexible material and said respective weight thereon.

2. A panel as claimed in claim 1 wherein the sheet of flexible material is impermeable to air.

3. A panel as claimed in claim 1 wherein each said weight is provided in the center of a said cell.

4. A panel as claimed in claim 1 wherein said flexible material is an elastomeric material.

5. A panel as claimed in claim 4 wherein said elastomeric material is rubber.

6. A panel as claimed in claim 1 wherein said weights have a mass in the range of 0.2 to 2.0 g.

7. A panel as claimed in claim 6 wherein each weight has the same mass.

8. A panel as claimed in claim 1 wherein said cells are square with a spacing of between 0.5 and 1.5 cm.

9. A panel as claimed in claim 1 wherein said sheet of flexible material covers multiple cells.

10. A panel as claimed in claim 1 wherein each cell is provided with a respective sheet of flexible material.

11. A panel as claimed in claim 1 wherein said sheet comprises multiple layers of said flexible material.

12. A sound attenuation structure comprising a plurality of panels stacked together wherein each said panel comprises a rigid frame divided into a plurality of individual cells, a sheet of a flexible material, and a plurality of weights wherein each said weight is fixed to said sheet of flexible material such that each cell is provided with a respective weight;

whereby resonant frequency of the sound attenuation structure is defined by the planar geometry of each said individual cell, the flexibility of said flexible material and said respective weight thereon.

13. A structure as claimed in claim 12 wherein each said panel is formed with different weights from other said panels in said structure.

14. A structure as claimed in claim 12 further including a sound absorption panel.

15. A sound attenuation structure comprising, a substantially acoustically transparent planar, rigid frame divided into a plurality of individual cells, a sheet of a flexible material, and a plurality of weights wherein each said weight is fixed to said sheet of flexible material such that each cell is provided with a respective weight, and a sound absorption panel, whereby resonant frequency of the sound attenuation structure is defined by the planar geometry of each said individual cell, the flexibility of said flexible material, and said respective weight thereon.

16. A sound attenuation panel comprising, a substantially acoustically transparent planar, rigid frame divided into a plurality of individual cells, a sheet of a flexible material fixed to the rigid frame, and a plurality of weights wherein each said weight is fixed to said sheet of flexible material such that each cell is provided with a respective weight, wherein said plurality of individual cells are two-dimensional cells.

* * * * *

US007395898C1

(12) EX PARTE REEXAMINATION CERTIFICATE (9678th)

United States Patent

Yang et al.

(10) Number: US 7,395,898 C1

(45) Certificate Issued: May 24, 2013

(54) SOUND ATTENUATING STRUCTURES

(75) Inventors: Zhi Yu Yang, Hong Kong (CN); Weijia Wen, Hong Kong (CN); Ping Sheng, Hong Kong (CN); Xixiang Zhang, Hong Kong (CN)

(73) Assignee: The Hong Kong University of Science and Technology, Kowloon (HK)

Reexamination Request:
No. 90/012,547, Sep. 14, 2012

Reexamination Certificate for:

| | |
|---|---|
| Patent No.: | **7,395,898** |
| Issued: | **Jul. 8, 2008** |
| Appl. No.: | **10/792,783** |
| Filed: | **Mar. 5, 2004** |

(51) Int. Cl.
*E04B 1/82* (2006.01)

(52) U.S. Cl.
USPC ..... 181/286

(58) Field of Classification Search
None
See application file for complete search history.

(56) References Cited

To view the complete listing of prior art documents cited during the proceeding for Reexamination Control Number 90/012,547, please refer to the USPTO's public Patent Application Information Retrieval (PAIR) system under the Display References tab.

*Primary Examiner* — Simon Ke

(57) ABSTRACT

There is disclosed a sound attenuation panel comprising, a rigid frame divided into a plurality of individual cells, a sheet of a flexible material, and a plurality of weights. Each weight is fixed to the sheet of flexible material such that each cell is provided with a respective weight and the frequency of the sound attenuated can be controlled by suitable selecting the mass of the weight.

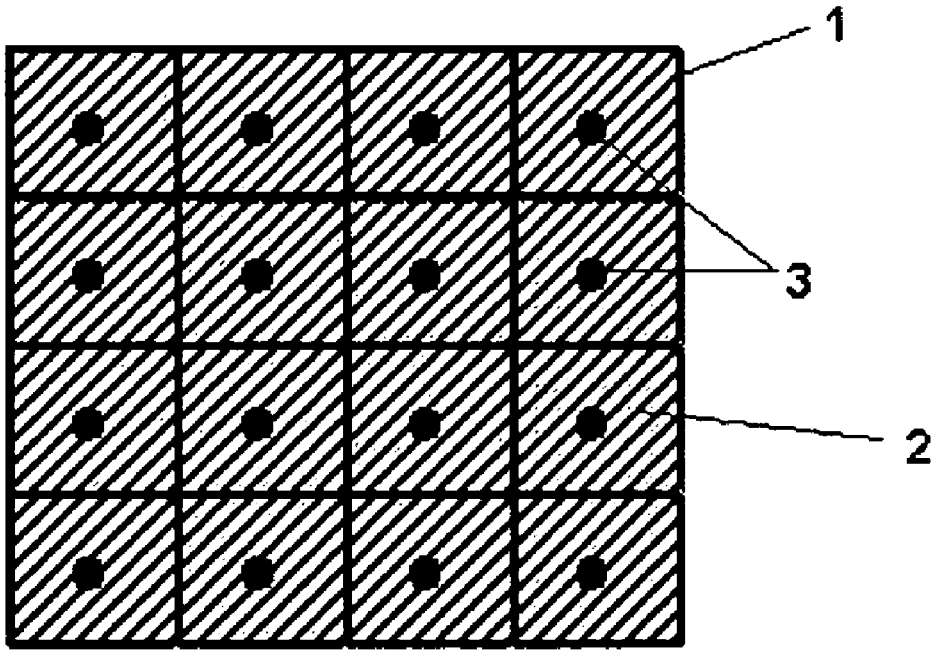

Top view of a schematic drawing of a LRSM panel

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 12, 15 and 16 are determined to be patentable as amended.

Claims 2-11, 13 and 14, dependent on an amended claim, are determined to be patentable.

1. A sound attenuation panel comprising, a substantially acoustically transparent planar, rigid frame divided into a plurality of individual cells, wherein said plurality of individual cells are generally two-dimensional cells, a sheet of a flexible material fixed to the rigid frame, and a plurality of weights wherein each said weight is fixed to said sheet of flexible material such that each cell is provided with a respective weight;

*wherein each cell is configured for attenuating sound, and* whereby resonant frequency of said sound attenuation panel is defined by the planar geometry of each said individual cell, the flexibility of said flexible material and said respective weight thereon.

12. A sound attenuation structure comprising a plurality of panels stacked together wherein each said panel comprises a rigid frame divided into a plurality of individual cells, a sheet of a flexible material, and a plurality of weights wherein each said weight is fixed to said sheet of flexible material such that each cell is provided with a respective weight;

*wherein each cell is configured for attenuating sound, and* whereby resonant frequency of the sound attenuation structure is defined by the planar geometry of each said individual cell, the flexibility of said flexible material and said respective weight thereon.

15. A sound attenuation structure comprising, a substantially acoustically transparent planar, rigid frame divided into a plurality of individual cells, a sheet of a flexible material, and a plurality of weights wherein each said weight is fixed to said sheet of flexible material such that each cell is provided with a respective weight, and a sound absorption panel,

*wherein each cell is configured for attenuating sound, and* whereby resonant frequency of the sound attenuation structure is defined by the planar geometry of each said individual cell, the flexibility of said flexible material, and said respective weight thereon.

16. A sound attenuation panel comprising, a substantially acoustically transparent planar, rigid frame divided into a plurality of individual cells, a sheet of a flexible material fixed to the rigid frame, and a plurality of weights wherein each said weight is fixed to said sheet of flexible material such that each cell is provided with a respective weight, wherein said plurality of individual cells are two-dimensional cells, *and*

*wherein each cell is configured for attenuating sound.*

* * * * *